US006216394B1

(12) United States Patent
Fenelon

(10) Patent No.: US 6,216,394 B1
(45) Date of Patent: Apr. 17, 2001

(54) WINDOW LIFT MECHANISM

(76) Inventor: Paul J. Fenelon, 13 Inverary, Nashville, TN (US) 37215

( * ) Notice: Subject to any disclaimer, the term of this patent is extended or adjusted under 35 U.S.C. 154(b) by 0 days.

(21) Appl. No.: 09/157,693

(22) Filed: Sep. 21, 1998

(51) Int. Cl.[7] ..... E05F 15/08

(52) U.S. Cl. ..... 49/349; 49/358; 49/362; 74/89.14; 74/89.17

(58) Field of Search ..... 49/358, 348, 349, 49/360, 361, 362; 74/89.14, 89.17

(56) References Cited

U.S. PATENT DOCUMENTS

| | | | | |
|---|---|---|---|---|
| 548,695 | | 10/1895 | Capron . | |
| 1,356,123 | | 10/1920 | Bell et al. . | |
| 1,903,358 | | 4/1933 | Nicholson . | |
| 1,937,662 | | 12/1933 | Nicholson . | |
| 1,939,159 | | 12/1933 | Atwood . | |
| 2,293,968 | | 8/1942 | Chandler et al. . | |
| 2,336,530 | | 12/1943 | Chandler et al. . | |
| 2,365,454 | | 12/1944 | Chandler et al. . | |
| 2,531,116 | | 11/1950 | Donoghue . | |
| 3,263,367 | | 8/1966 | Tanaka . | |
| 4,167,834 | | 9/1979 | Pickles . | |
| 4,170,847 | | 10/1979 | Pickles . | |
| 4,182,078 | * | 1/1980 | Bartholomew | 49/363 X |
| 4,389,818 | | 6/1983 | Sakamoto . | |
| 4,400,913 | | 8/1983 | Krantz et al. . | |
| 4,878,396 | * | 11/1989 | Grunberg | 74/89.17 X |
| 4,908,988 | * | 3/1990 | Yamamura et al. | 49/358 |
| 4,910,917 | | 3/1990 | Brauer . | |
| 4,967,510 | | 11/1990 | Torii et al. . | |
| 5,000,055 | * | 3/1991 | Kim | 74/89.17 |
| 5,005,316 | | 4/1991 | Hornivius . | |
| 5,022,184 | | 6/1991 | Yamamura et al. . | |
| 5,058,322 | | 10/1991 | Sambor . | |
| 5,410,921 | | 5/1995 | Deynet et al. . | |
| 5,537,782 | * | 7/1996 | Klippert et al. | 49/358 |
| 5,577,347 | | 11/1996 | Heckel et al. . | |
| 5,794,478 | | 8/1998 | Chen . | |
| 5,806,244 | | 9/1998 | Tilli . | |
| 5,836,205 | * | 11/1998 | Meyer | 74/89.17 |

FOREIGN PATENT DOCUMENTS

| | | |
|---|---|---|
| 1931471 | 12/1970 | (DE) . |
| 2217784 | 10/1973 | (DE) . |
| 2544174 | 4/1977 | (DE) . |
| 2841440 | 4/1980 | (DE) . |
| 3243123 | 5/1984 | (DE) . |
| 3545856 | 1/1987 | (DE) . |
| 4005759 | 8/1991 | (DE) . |
| 29613322 | 10/1996 | (DE) . |
| 197 03 720 A1 | 7/1998 | (DE) . |
| 1425449 | 4/1966 | (FR) . |
| 2111220 | 6/1972 | (FR) . |
| 2550267 | 2/1985 | (FR) . |
| 2650647 | 2/1991 | (FR) . |
| 851436 | 10/1960 | (GB) . |
| 9737099 | 10/1997 | (WO) . |
| WO 98/2615 | 6/1998 | (WO) . |

* cited by examiner

*Primary Examiner*—Jerry Redman
(74) *Attorney, Agent, or Firm*—Harness, Dickey & Pierce, P.L.C.

(57) ABSTRACT

A window lift mechanism for raising and lowering a window in a vehicle door includes a support bracket mounted to the window and a motor supported on the support bracket. A pair of parallel, vertical racks are mounted to the door and are positioned immediately adjacent the window. Pinion gears driven by the motor are supported on the support bracket and engaged with the rack to permit vertical movement of the window.

29 Claims, 9 Drawing Sheets

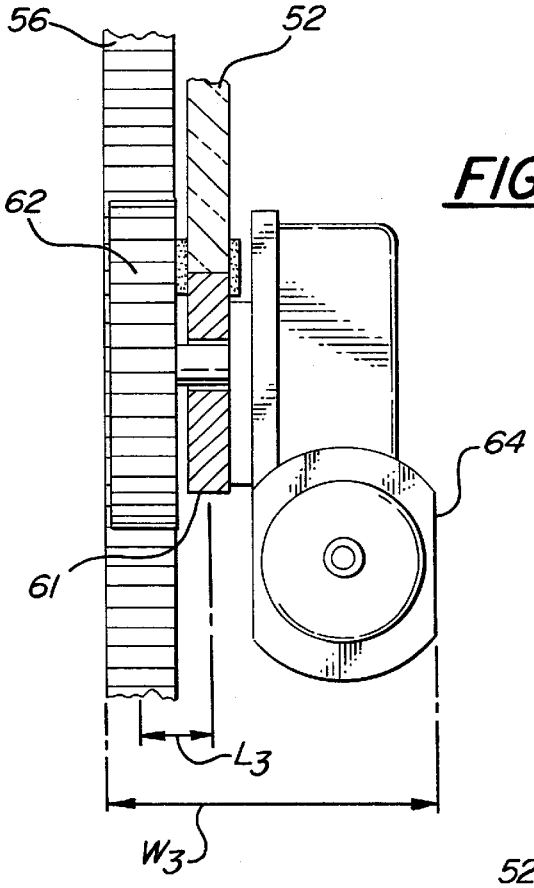
FIG-5
FIG-4
PRIOR ART
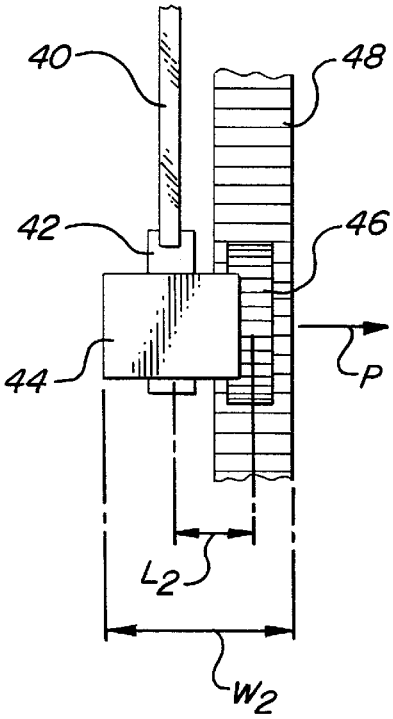
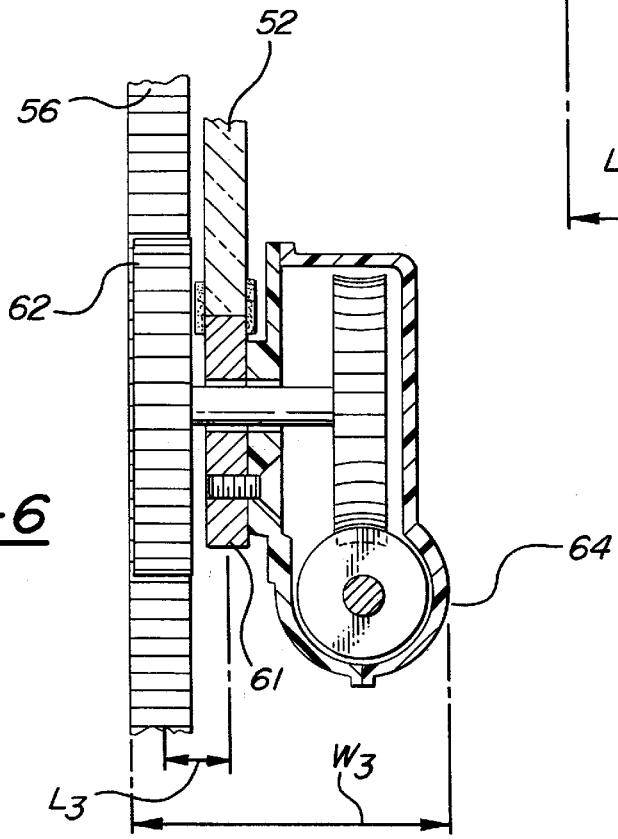
FIG-6

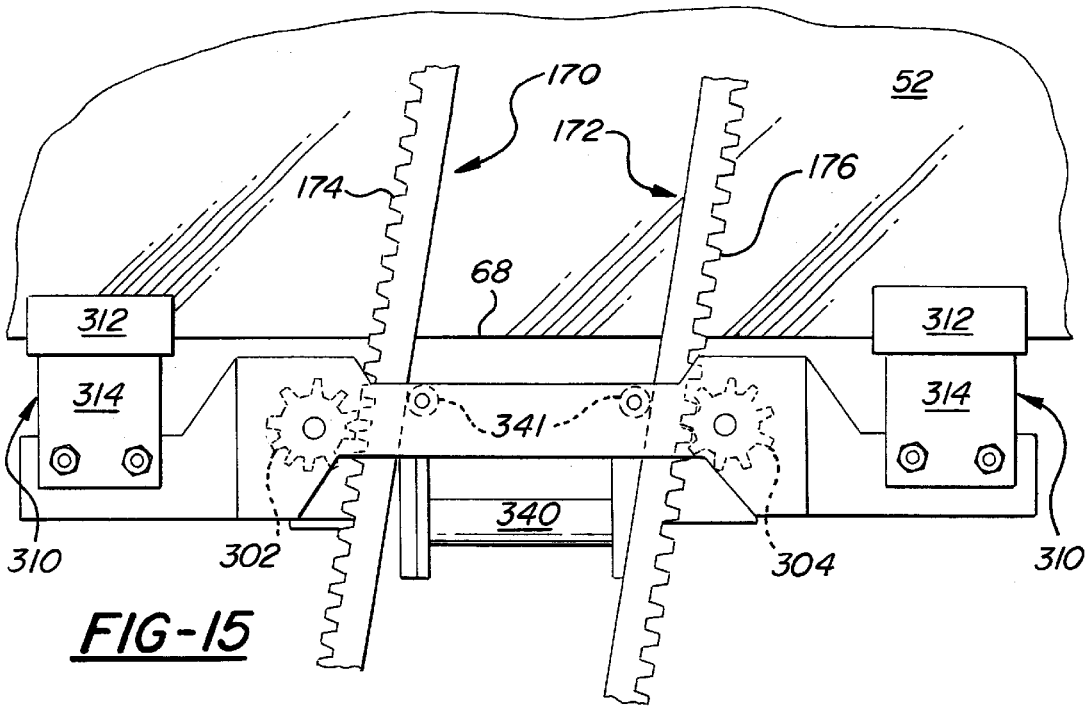
FIG-15
FIG-16
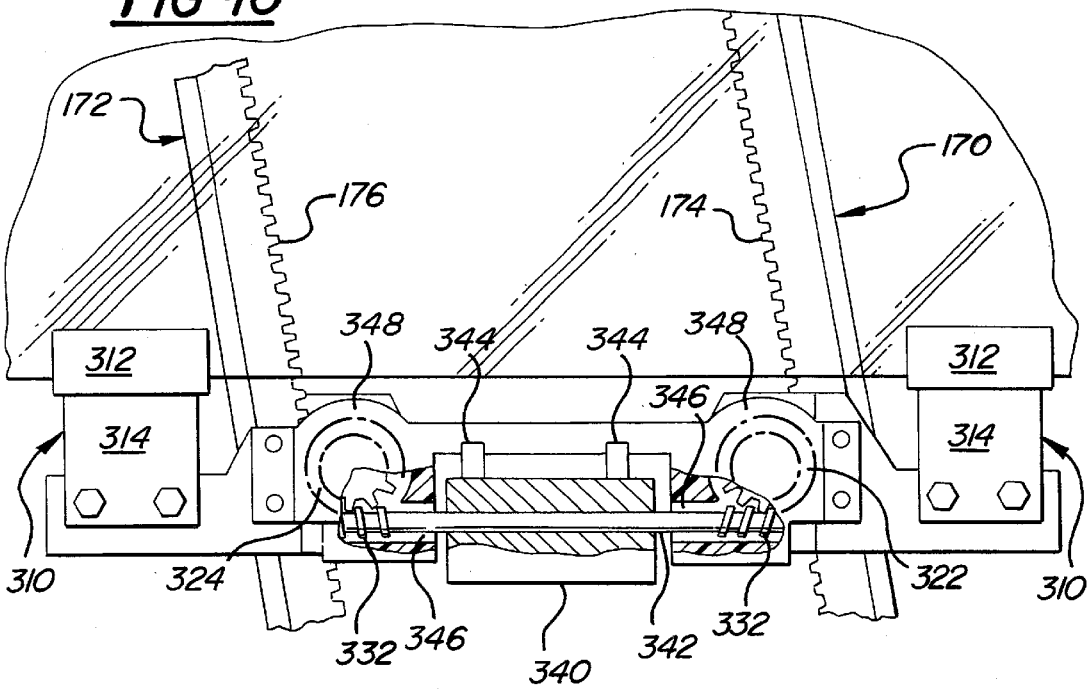

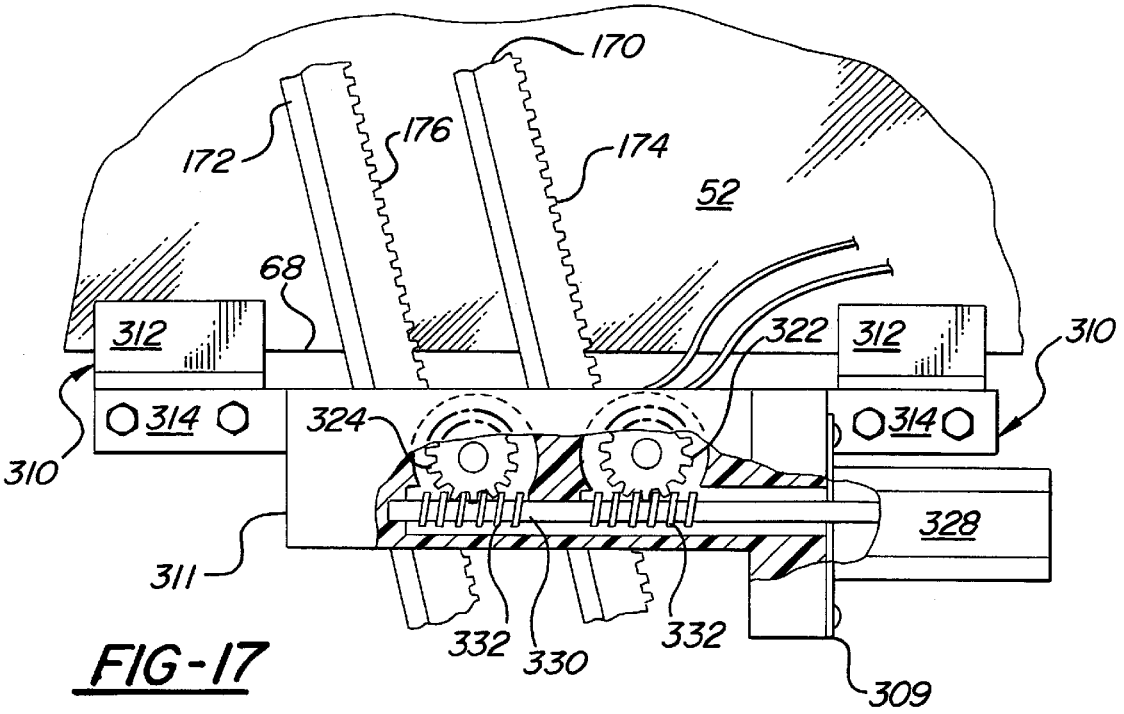
FIG-17
FIG-18
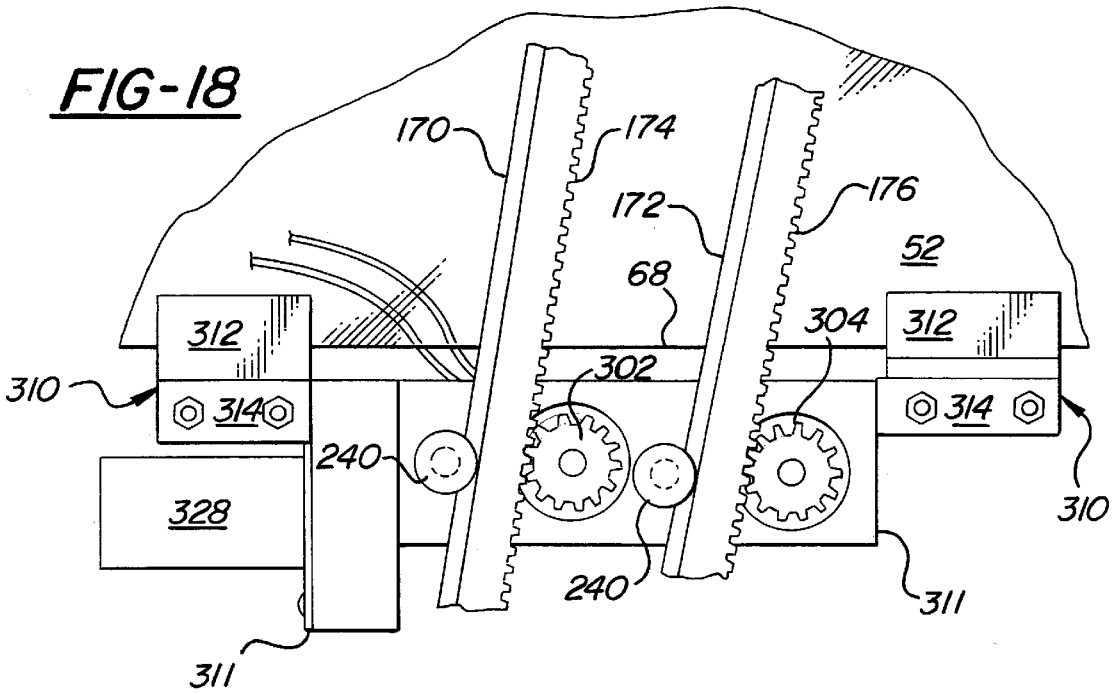

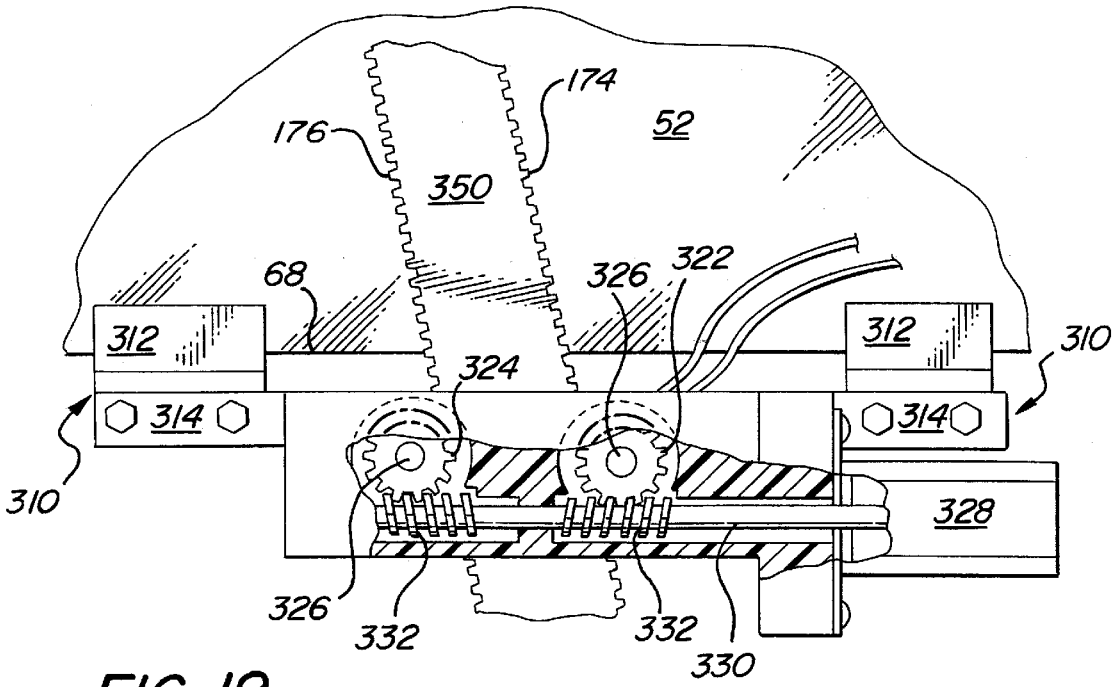
FIG-19
FIG-20
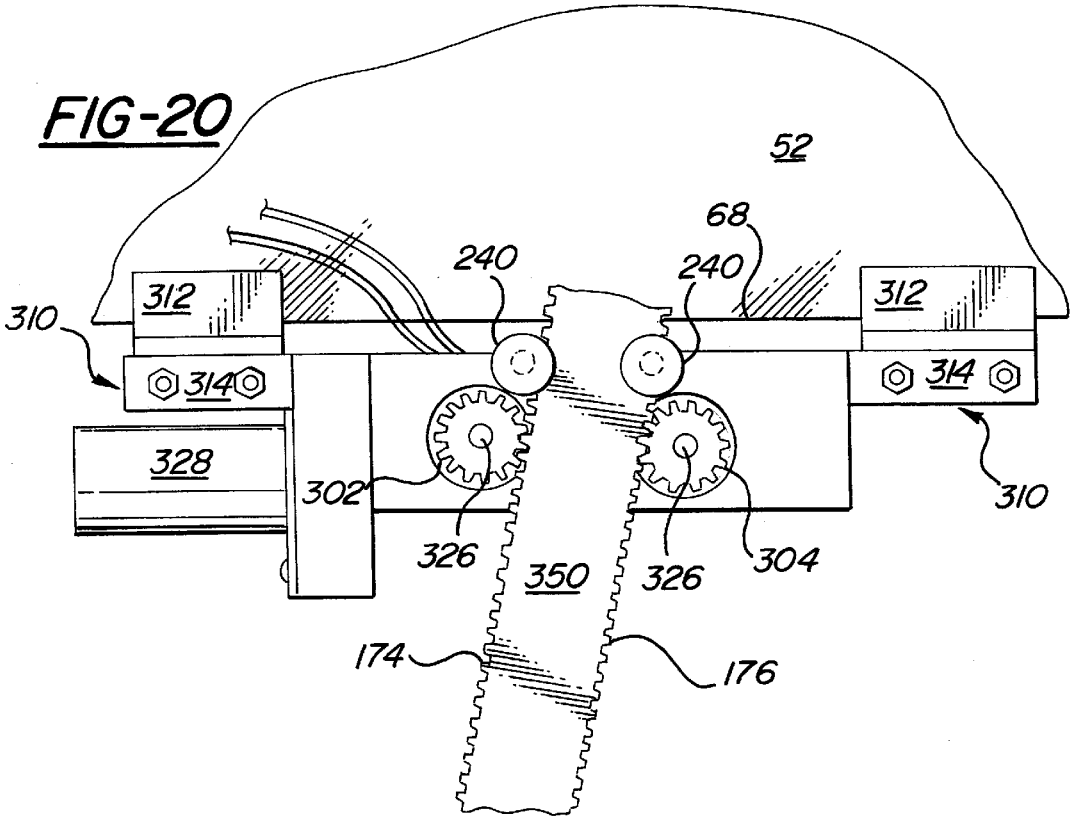

WINDOW LIFT MECHANISM

TECHNICAL FIELD

The subject invention generally relates to an apparatus for moving a closure member, such as a window, into an open or closed position.

BACKGROUND ART

All modem automobiles include a window lift assembly for raising and lowering windows in the door of the vehicle. The most common type of window lift assembly incorporates a "scissor mechanism." As shown in FIG. 1, a scissor-type system includes a door 10, a window 12 vertically moveable within the door 10, a horizontal support bracket 14 on the window 12, and a scissor mechanism 16 supported on the door 10 and engaged with a track 17 on the support bracket 14. A sector rack 18 is supported on the scissor mechanism 16, and a pinion gear 20 supported on the door 10 is engaged with the sector rack 18. In vehicles with power windows, a worm gear 22 driven by a motor 24 is engaged with a driven gear 26 which, in turn, is operatively joined to the pinion gear 20. The motor 24, worm gear 22, and driven gear 26 are all mounted to the door 10 of the vehicle. In vehicles without power windows (not shown), the pinion gear is driven by a manual hand-crank.

Unfortunately, the scissor-type mechanism includes many drawbacks such as the large amount of space and numerous parts required. The scissor-type mechanism is also mechanically inefficient, prohibiting the use of light-weight materials and requiring the use of relatively large motors to drive the system. The large motors necessarily require increased space and electrical power and also increase the weight of the system. With the limited space in a scissor-type system it is also necessary, in order to provide the required torque transfer efficiency and acceptable up and down times (3–4 seconds), to have a small diameter pinion gear, typically 0.5 to 0.75 inches, and relatively large driven gear, typically 1.8 to 2.5 inches in diameter, with gear ratios of 9 to 16 and 80 to 90, respectively. This results in excessive worm gear speed in the range of 3000 to 4000 RPM which causes excessive driven gear tooth shock and armature noise. The combination of high torque, typically 80 to 125 inch-pounds at stall, and shock due to high worm speeds mandates that either expensive multiple gears and/or single driven gears with integral shock absorbers be utilized.

In U.S. Pat. No. 4,167,834 to Pickles, a more mechanically efficient vertical rack and pinion window lift system is disclosed. This type of system is represented in FIGS. 2 and 3 and includes a door 28, a window 30 vertically moveable within the door 28, a support bracket 32 on the window 30, a vertical rack 34 supported on the door 28, and a pinion gear 36 supported on the support bracket 32 in engagement with the rack 34. A motor 38 is supported on the support bracket 32 on the same side of the window 30 as the rack 34 and pinion gear 36 and drives the pinion gear 36 through a worm gear/driven gear transmission (not shown) engaged with the pinion gear 36. The pinion gear 36 is continually meshed with the rack 34 to drive the window 30 up and down. Obvious advantages of this system are the mechanical efficiency, fewer parts and, hence, reduced weight, and reduced motor size. The system is also more simple to install than the scissor-type system.

The Pickles window lift assembly, while theoretically plausible, does not function adequately due to the complex method and arrangement used to adapt the support bracket 32, motor 38, worm gear, and driven gear to the window 30.

As discussed in United States Patent No. 4,967,510 to Torii et al., in window lift systems of the type shown in FIGS. 2 and 3 (such as the Pickles system) a larger torque than necessary is required to drive the system due to the angular moment set up by the weight of motor 38 and related structure acting upon moment arm $L_1$. In addition, more space than necessary is required due to the "superimposed sequential" stacking of components in the thickness direction of the door resulting in an overall width $W_1$.

The system disclosed in the patent to Torii et al. improved substantially over Pickles in its functional adaptability. The Torii system is represented in FIG. 4 and includes a window 40, a support bracket 42 on the window 40, a motor 44, a pinion gear 46, and a rack 48. To eliminate the angular moment on the window 40 caused by the weight of the motor 44, the Torii system positioned the motor 44 such that the center of gravity of the motor 44 was substantially aligned with the plane of movement of the window 40. However, as shown in FIG. 4, this arrangement prevents the rack 48 from being positioned as close as possible to the window 40, resulting in an increased angular moment on the window 40 caused by the torque generated at the rack/pinion gear interface acting upon a larger than necessary moment arm $L_2$ (due to the larger than necessary overall width $W_2$). The angular moment can cause the window to "pull in" in the direction shown by the arrow labeled P. Further, although not shown in FIG. 4, the Torii system includes a support bracket for supporting the window 40 and motor 44. Similar to the Pickles system, the support bracket is "sequentially stacked" with respect to the motor, unnecessarily increasing the overall width of the system.

In co-pending U.S. patent application Ser. No. 08/762,447, now U.S. Pat. No. 6,073,395 filed Dec. 9, 1996 by Fenelon, the inventor of the present application, the restrictive and rigid systems presented by Pickles and Torii et al. were vastly improved upon by incorporating controlled flexibility into the rack system, hence providing for smooth operation as the window is raised and lowered. The system also reduced the number of components by "modularizing" the support bracket and minimizing the torque placed on the window by altering the "stacking arrangement" of the motor plus transmission, support bracket, and rack plus driven gear. This improved arrangement is shown in FIGS. 5 and 6 where reference numeral 52 is the window, 64 is the motor attached to the inside of support bracket 61, and 62 is the pinion gear intermeshed with rack 56. Note that $W_3$ is the total width of the stacked arrangement and $L_3$ is the moment which produces torque on window 52. Similar to Pickles and Torii et al., Fenelon's improved arrangement "sequentially stacks" the components, unnecessarily increasing the overall width of the system.

Therefore, it is desirable to provide a window lift system which includes the benefits of a rack and pinion system, allows for smooth operation as the window is raised and lowered, and minimizes the torque placed on the window. Additionally, it is desirable to minimize the space occupied by the various components in all dimensions and particularly in the thickness direction of the door, and further to minimize the total number of components and hence the overall weight of the system.

SUMMARY OF THE INVENTION AND ADVANTAGES

In one embodiment of the present invention, a closure assembly is provided including a closure member, a support bracket joined to the closure member, a first pinion gear supported by the support bracket, and a first rack operatively engaged with the first pinion gear. A driven gear is supported for rotation by the support bracket and is operatively joined with the pinion gear. A motor is supported by the support bracket and includes an output shaft engaged with the driven gear. The support bracket fulfills a dual function by simultaneously acting as a transmission housing. The motor defines a profile in a width-wise direction, and the support bracket is positioned substantially within the width-wise profile of the motor. In this manner, the space occupied by the motor and support bracket can be minimized while further reducing the number of individual components required.

In another embodiment of the present invention, a closure assembly is provided including a closure member, a support bracket joined to the closure member, a first pinion gear supported by the support bracket, and a first rack operatively engaged with the first pinion gear. A driven gear is supported for rotation by the support bracket and is operatively joined with the pinion gear. A motor is provided including an output shaft having a worm gear engaged with a driven gear. The motor is supported at a first distal end of the support bracket wherein the output shaft extends toward a second distal end of the support bracket. In this embodiment as well, the space occupied by the motor and support bracket can be minimized together with minimizing the total number of components.

In another embodiment of the present invention, a closure assembly is provided including a closure member, a support bracket joined to the closure member, and a rack. The rack comprises a longitudinal rail including teeth on first and second opposing sides of the rail. A first pinion gear is supported by the support bracket and engaged with the teeth on a first side of the rack, and a second pinion gear is supported by the support bracket and engaged with the teeth on a second side of the rack. In this embodiment, the rack is adapted to engage dual pinion gears without requiring the expense and space of two separate racks.

BRIEF DESCRIPTION OF THE DRAWINGS

Other advantages of the present invention will be readily appreciated from the following detailed description of the invention when considered in connection with the accompanying drawings wherein:

FIG. 4 is a cross-sectional view of a second prior art rack-and-pinion window lift assembly;

FIG. 5 is a cross-sectional side-view of a third rack and pinion window lift assembly;

FIG. 6 is a cross-sectional view illustrating the motor assembly shown in FIG. 5;

FIG. 15 is a front perspective view of the second embodiment of the invention;

FIG. 16 is rear perspective view of the second embodiment of the invention in which the driven gears are disposed between the racks;

FIG. 17 is a rear perspective view of a third embodiment of the invention;

FIG. 18 is a front perspective view of the third embodiment of the invention;

FIG. 19 is a rear perspective view of a fourth embodiment of the invention; and FIG. 20 is a front perspective view of the fourth embodiment of the invention.

DETAILED DESCRIPTION OF THE PREFERRED EMBODIMENTS

Figure 7:
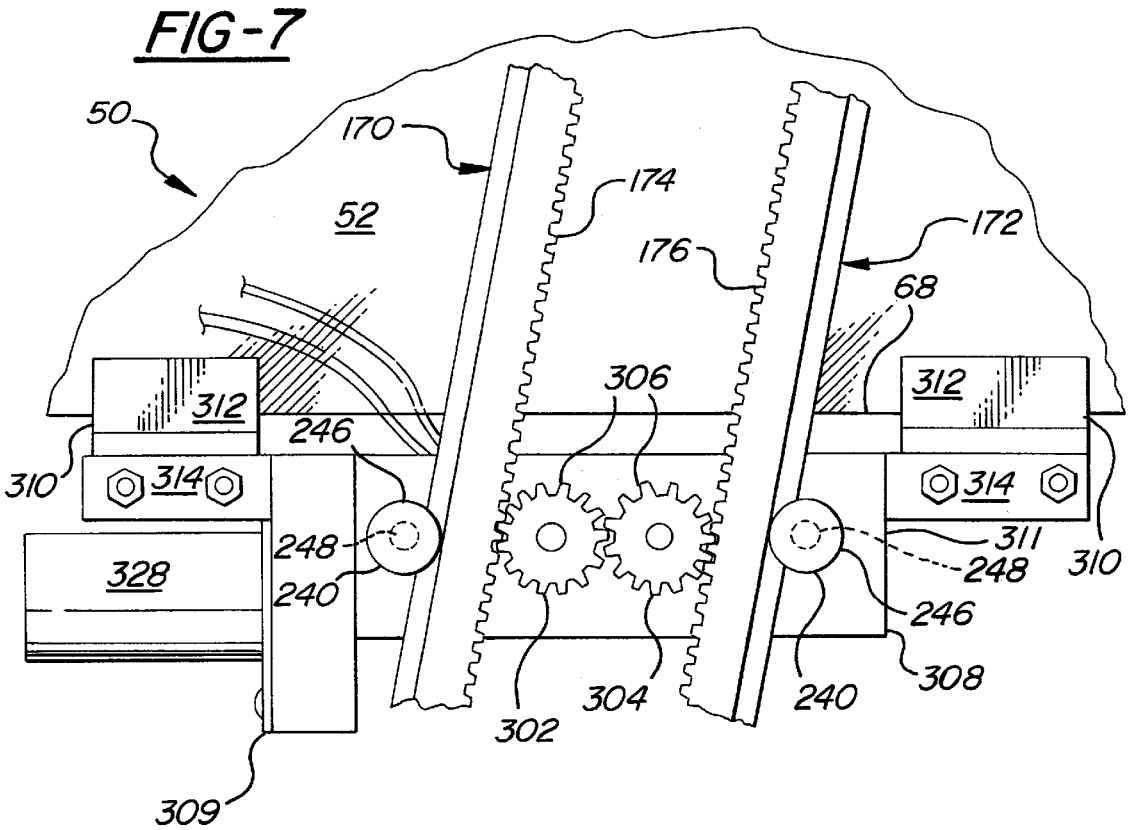
FIG. 7 is a front perspective view of a first embodiment of the invention in which the pinion gears are engaged.
Figure 8:
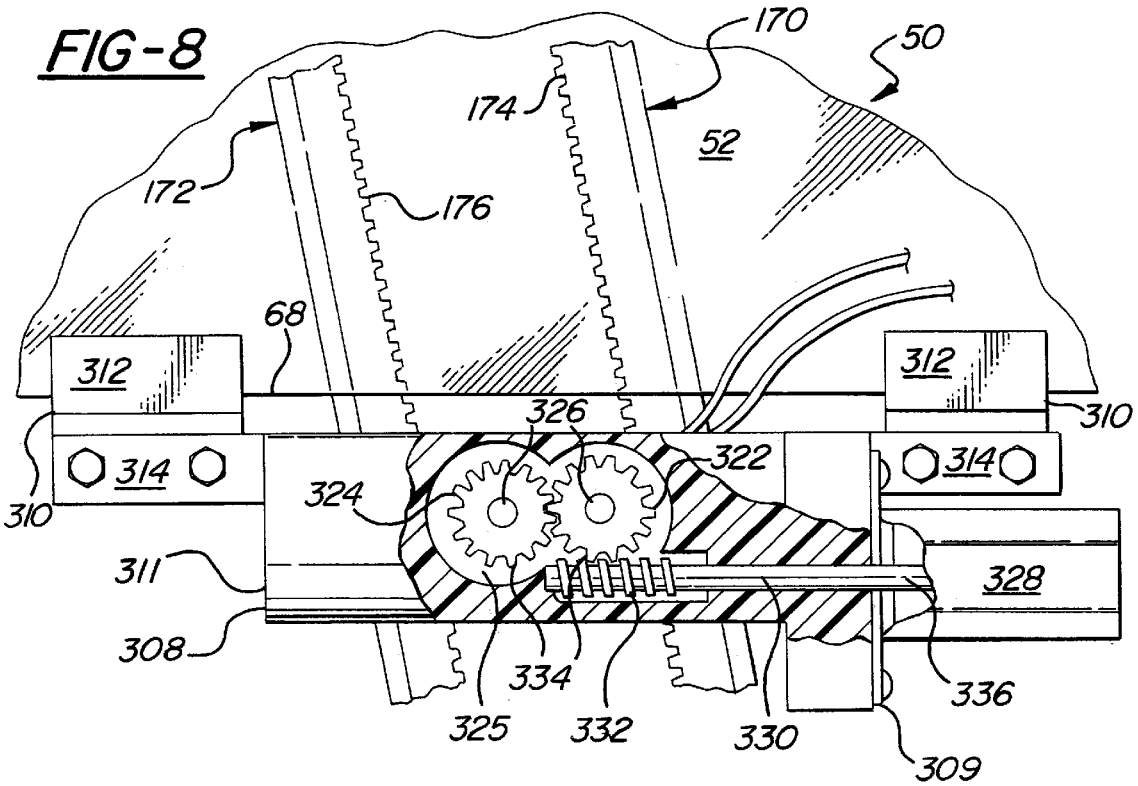
FIG. 8 is a rear perspective view of the first embodiment of the invention in which the driven gears are engaged.
Figure 9:
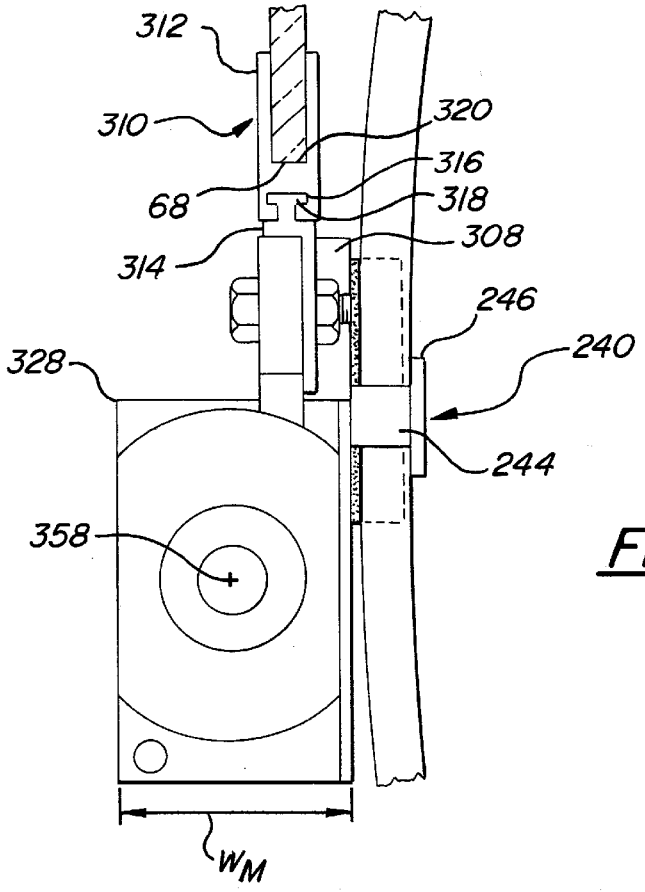
FIG. 9 is a side view of the first embodiment of the invention.

A first embodiment of the invention is shown in FIGS. 7–9 and comprises a closure assembly 50 for moving a closure member, such as a window 52, into an open or closed position. Referring to FIGS. 7 and 8, the closure assembly 50 includes first and second parallel racks 170,172. The first rack 170 includes a row of teeth 174 which faces a row of teeth 176 on the second rack 172. As shown in FIG. 7, first and second pinion gears 302, 304 are provided which include teeth 306 in engagement with the teeth 174,176 on the first and second racks 170,172. The first and second pinion gears 302,304 are also in engagement with one another.

As shown in FIGS. 7 and 8, a plastic support bracket 308 supports the window 52. The support bracket 308 is a longitudinal member including first and second distal ends 309,311. Two mounting feet 310 join the window 52 to the support bracket 308 and permit limited side-to-side movement of the window 52. Referring to FIG. 9, the mounting feet 310 each comprise a bracket 312 joined to a lower edge 68 of the window 52 and a base member 314 joined to the support bracket 308. Each bracket 312 includes a lower C-shaped channel 316 which surrounds a flange 318 on the base member 314 and permits the bracket 312 to slide relative to the base member 314. The lower edge 68 of the window 52 is received within a U-shaped channel 320 on each mounting foot 310.

As the assembly is installed, the mounting feet 310 are first permanently attached to the bottom edge 68 of the window 52. The window 52 is then dropped into place relative to the support bracket 308 such that the base member 314 of each mounting foot 310 will be bolted, riveted, or otherwise attached to the support bracket 308. As shown in FIG. 9, the window is installed as close as possible to the racks 170,172 without contacting the racks 170,172.

Referring to FIGS. 7 and 9, guide members 240 are provided on the support bracket 308 adjacent the first and second racks 170,172. The guide members 240 ensure that the first and second racks 170,172 remain in engagement with the first and second pinion gears 302,304. As shown in FIG. 9, the guide members 240 comprise spool shaped, plastic members having a cylindrical body 244 extending perpendicularly from the support bracket 308 and a circular flange 246 extending radially outwardly from a distal end of the body 244. The guide members 240 are rotatably supported by cylindrical posts 248 (shown in phantom in FIG. 7) extending perpendicularly from the support bracket 308.

The first and second pinion gears 302,304 (shown in FIG. 7) are operatively connected, respectively, to first and second driven gears 322,324 (shown in FIG. 8). The first and second driven gears 322,324 are engaged such that rotation of the first driven gear 322 produces corresponding rotation of the second driven gear 324. Referring to FIG. 8, a central shaft 326 joins each pinion gear 302,304 to its respective driven gear 322,324. The driven gears 322,324 are contained within an internal compartment 325 in the support bracket 308.

Because the pinion gears 302,304 are engaged, it is not necessary to provide a second driven gear 324 engaged with the first driven gear 322 as shown in FIG. 7. Instead, the second pinion gear 304 can be driven solely by the engagement with the first pinion gear 302. Similarly, it is not necessary that the first and second pinion gears 302,304 be engaged (as shown in FIG. 8) as long as the first and second driven gears 322,324 are engaged.

Referring to FIG. 8, a motor 328 is supported on the support bracket 308 and includes a single output shaft 330 having a worm gear 332 formed at a distal end thereof. The worm gear 332 is helical and directly engages with teeth 334 on the first driven gear 322. The motor 328 is mounted to the first distal end 309 of the support bracket 308 and the output shaft 330 extends toward the second distal end 311 within an internal passage 336. As shown in FIG. 9, the motor 328 defines a profile $W_m$, or "footprint", in a width-wise direction generally perpendicular to the window 52. The support bracket 308 has a width approximately equal to the width of the motor 328 and is positioned within the width-wise profile $W_m$ of the motor 328. In this manner, the combined width of the support bracket 308 and motor 328 can be minimized compared to other embodiments with which the support bracket 308 and motor 328 are "stacked" in a width-wise direction. Preferably, the motor 328 has a width of approximately 35 millimeters or less. The support bracket 308 integrally fulfills the dual function of supporting the window 52 as well as providing a transmission housing for the worm gear 332 and driven gears 322,324.

As shown in FIG. 9, the motor 328 includes a center of gravity designated at 338 located on a first side of the window 52. The racks 302,304 are located on a second side of the window 52. This arrangement provides distinct advantages by permitting the racks 170,172 to be as close as possible to the window 52. The center of gravity 338 of the motor 328 will remain close enough to the window 52, however, to avoid excessive torque on the window 52 caused by the weight of the motor 328.

Although not shown in the figures, an O-ring or other type of seal can be provided at the interface between the pinion gears 302, 304 and the support bracket 308 to prevent moisture from entering the internal components of the motor 308 and causing corrosion and premature failure of the motor 308.

Figure 10:
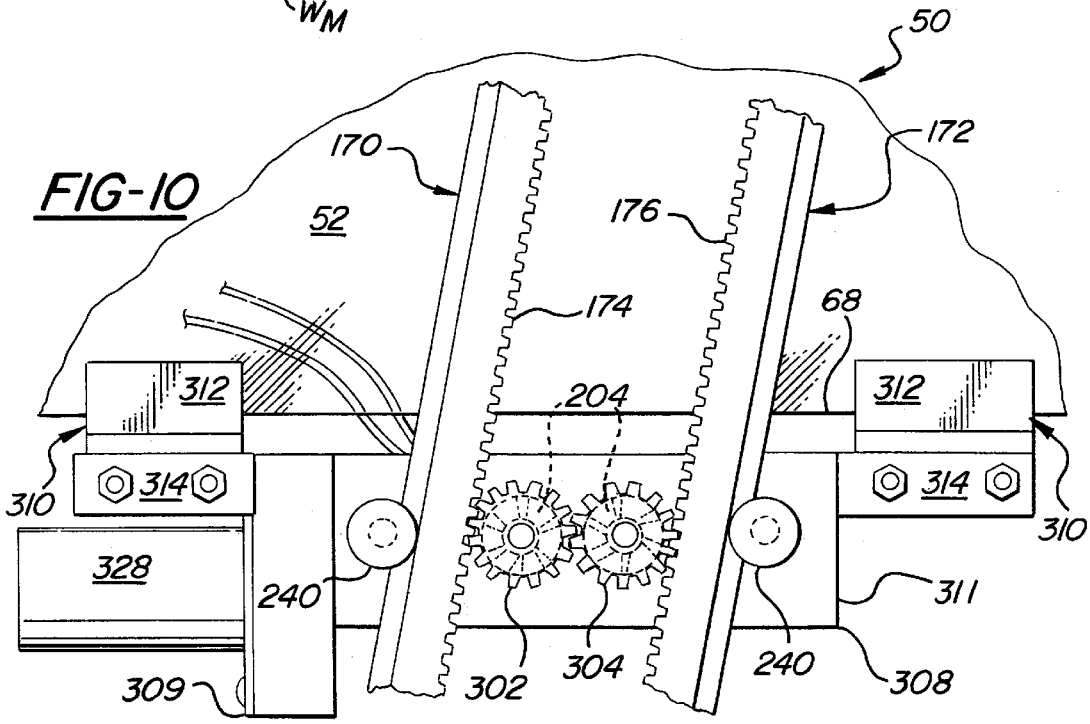
FIG. 10 is a front perspective view of the first embodiment of the invention illustrating resilient shock absorbers engaged with each pinion gear.

The pinion gears 302,304 shown in FIG. 7 do not include any form of internal shock absorber. However, depending upon the demands to be placed on the system, it may be desirable to place resilient shock absorbers 204 within one or both pinion gears 302,304 as shown in FIG. 10. The resilient shock absorbers 204 are formed of an elastomeric material such as Santoprene 55. The configuration of the shock absorbers 204 is discussed in detail in Applicant's co-pending application Ser. No. 08/762,447, now U.S. Pat. No. 6,073,395 filed Dec. 9, 1996.

Figure 11:
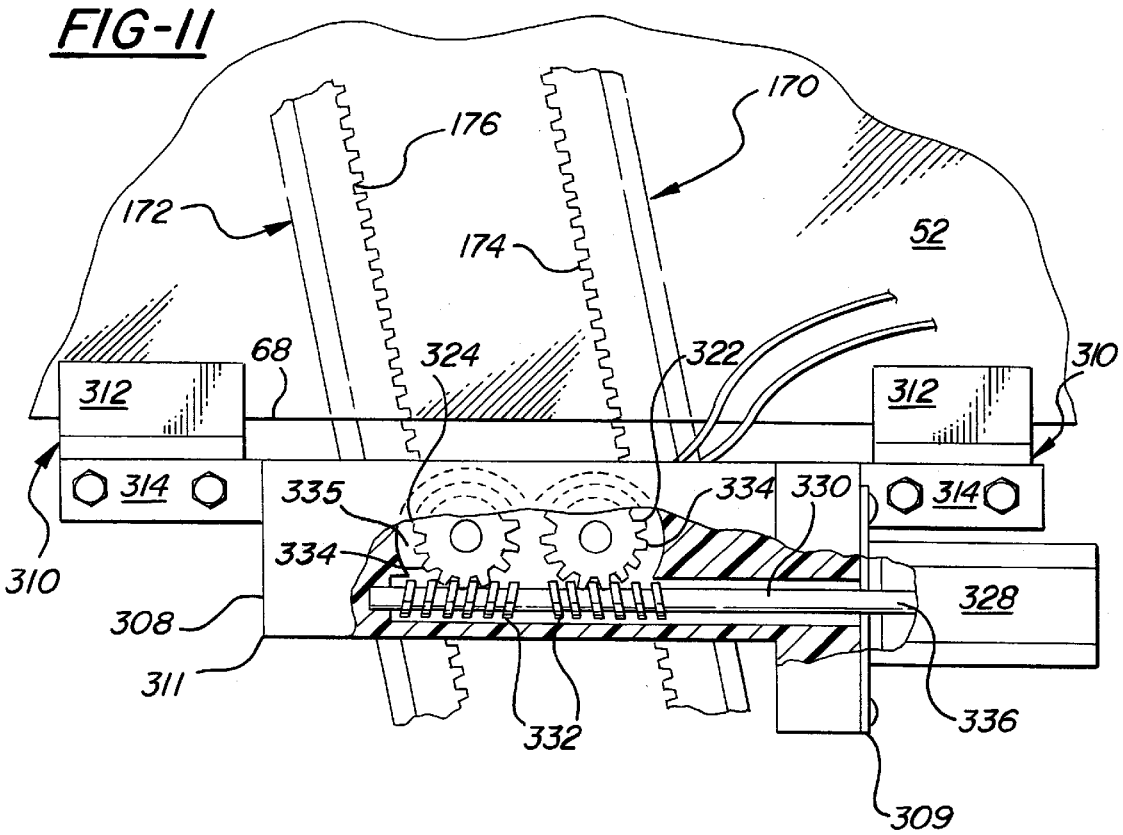
FIG. 11 is a rear perspective view of the first embodiment of the invention in which the driven gears are not engaged.
Figure 12:
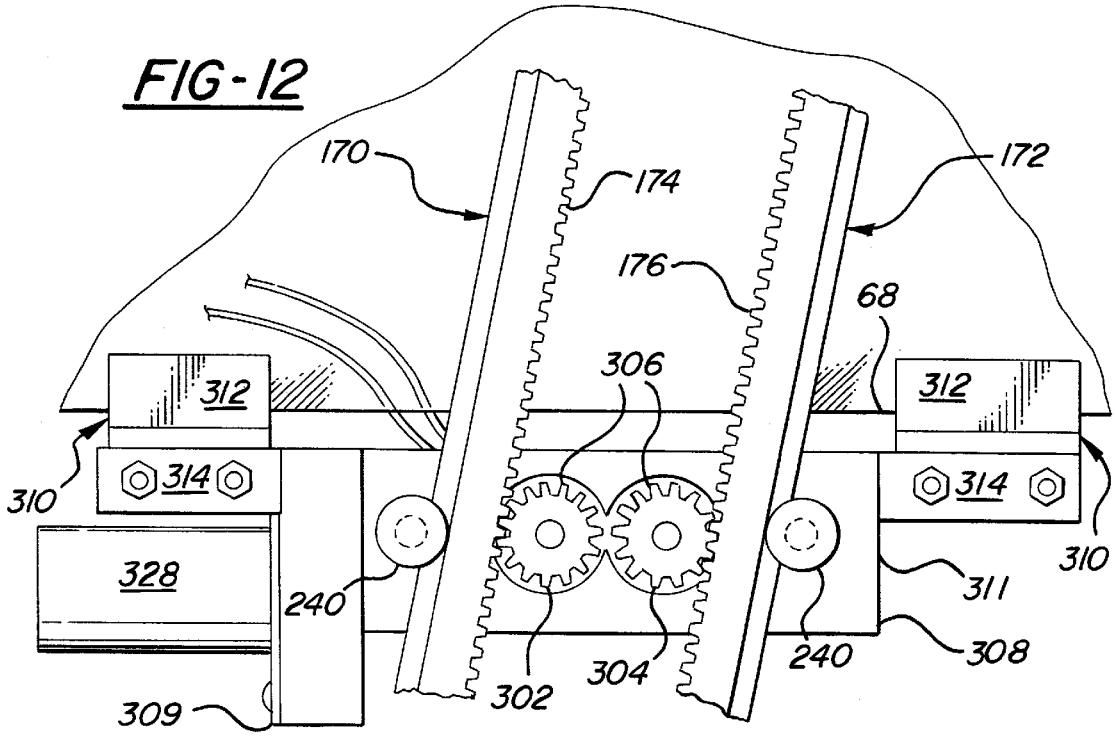
FIG. 12 is a front perspective view of the first embodiment of the invention in which the pinion gears are not engaged.

FIGS. 11 and 12 illustrate an alternative configuration in which the output shaft 330 of the motor 328 includes dual worm gears 332 engaged with the first and second driven gears 322,324. The first and second driven gears 322,324 (shown in FIG. 11) are not engaged because each is independently driven by the dual worm gears 332. Similarly, the first and second pinion gears 302,304 (shown in FIG. 12) are not engaged because each receives torque from its respective driven gear 322,324. In all other respects, this configuration is the same as discussed above with respect to FIGS. 7–10.

Figure 13:
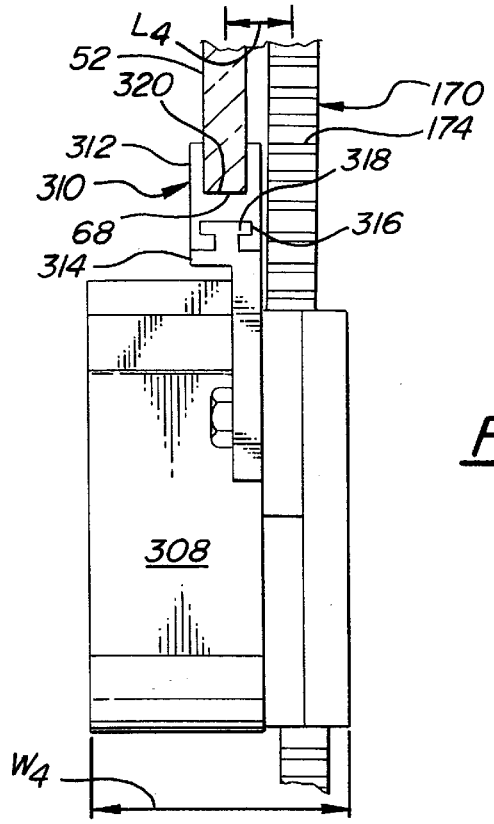
FIG. 13 is a side view of a second embodiment of the invention.
Figure 14:
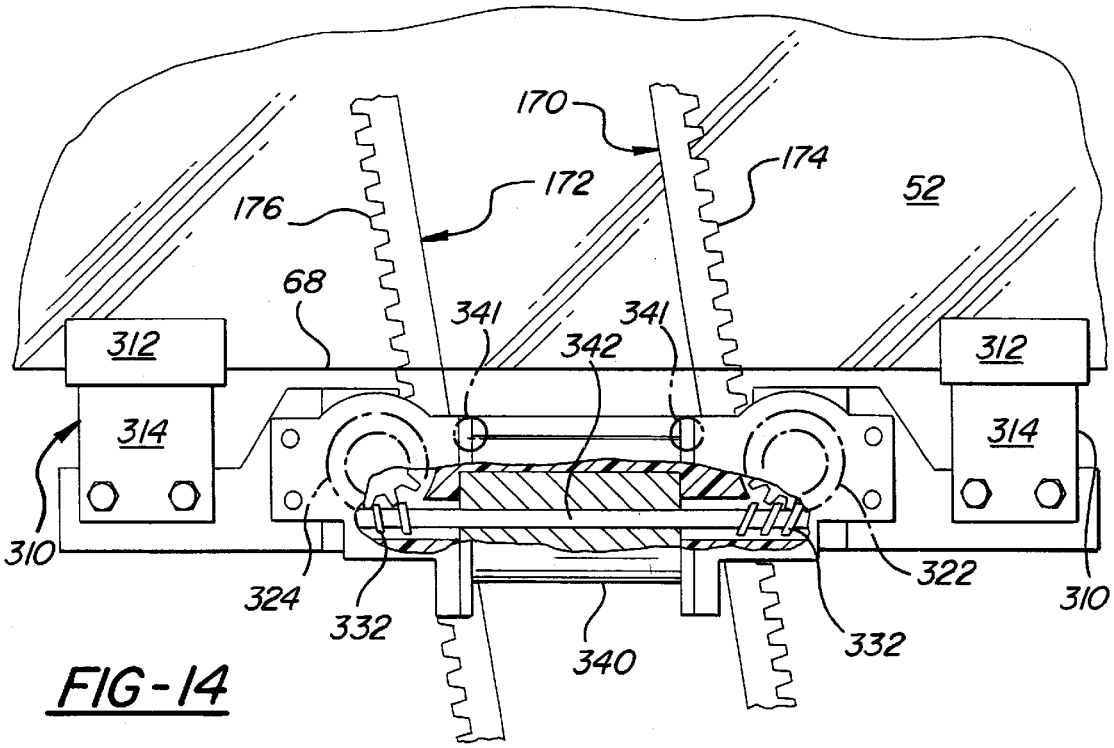
FIG. 14 is a rear perspective view of the second embodiment of the invention.

A second embodiment is shown in FIGS. 13–15 and is similar to the first embodiment discussed above. Unlike the first embodiment, however, the racks 170,172 include outwardly facing rows of teeth 174,176 which engage with the first and second pinion gears 302,304 (shown in FIG. 15). Guide wheels 341 (shown in phantom in FIGS. 14 and 15) engage the racks 170,172 to prevent the racks 170,172 from moving out of engagement with the pinion gears 302,304. As shown in FIG. 13, the window 52 is positioned as close as possible to the racks 170,172 without physically touching the racks 170,172.

As shown best in FIG. 14, a motor 340 is integrated within the support bracket 308 and has a dual-ended output shaft 342 including a worm gear 332 at each end of the output shaft 342. The worm gears 332 engage with driven gears 322,324 which are, in turn, operatively connected with the pinion gears 302,304. The worm gears 332 have opposite helical angles such that the pinion gears 302, 304 will rotate in opposing directions as is required to ensure that the pinion gears 302,304 cooperate during vertical movement of the window 52.

Further, one or both pinion gears 302,304 can be provided with a resilient shock absorber 204 as shown in FIG. 10 with respect to the first embodiment.

As shown in FIG. 16, the racks 170,172 can alternatively be spaced farther apart such that the pinion gears 302,304, motor 340, and driven gears 322,324 are disposed between the racks 170,172. In this configuration, the teeth 174,176 on the racks 170,172 are located on inwardly facing sides of the racks 170,172. The motor 340 is mounted on the support bracket 308 by retaining straps 344. The dual-ended output shaft 342 is supported for rotation by bearings 346 and includes a worm gear 332 at each end thereof. The worm gears 332 engage with driven gears 322,324 in the same manner as discussed above. Seal caps 348 are sonic welded to the support bracket 308 to cover the driven gears 322,324 and prevent entry of water or debris.

A third embodiment is shown in FIGS. 17 and 18 and includes parallel racks 170,172 engaged with dual pinion gears 302,304 similar to the first embodiment discussed above. Referring to FIG. 17, the motor 328 includes a single-ended output shaft 330 having worm gears 332 thereon engaged with first and second driven gears 322,324. Unlike the first embodiment, however, the teeth 174 on the first rack 170 face the same direction as the teeth 176 on the second rack 172. Thus, as shown in FIG. 18, the first pinion gear 302 is disposed between the first and second racks 170,172 while the second pinion gear 304 is engaged with the rack teeth 176 on an outwardly facing edge of the second rack 172. In all other ways the third embodiment is identical to the first embodiment.

A fourth embodiment is shown in FIGS. 19 and 20 and includes a flexible rack 350 formed from a single, longitudinal rail having first and second rows of teeth 174,176 on opposing sides of the rack 350. A motor 328 is provided having a single-ended output shaft 330 including a pair of worm gears 332 thereon. The worm gears 332 engage with driven gears 322,324 which are, in turn, operatively connected to pinion gears 302,304 by central shafts 326. As shown in FIG. 20, the pinion gears 302,304 straddle the rack 350 and engage the rack teeth 174,176. Guide members 240 are also provided and prevent the rack 350 from moving in a direction perpendicular to the window 52.

Figure 1:
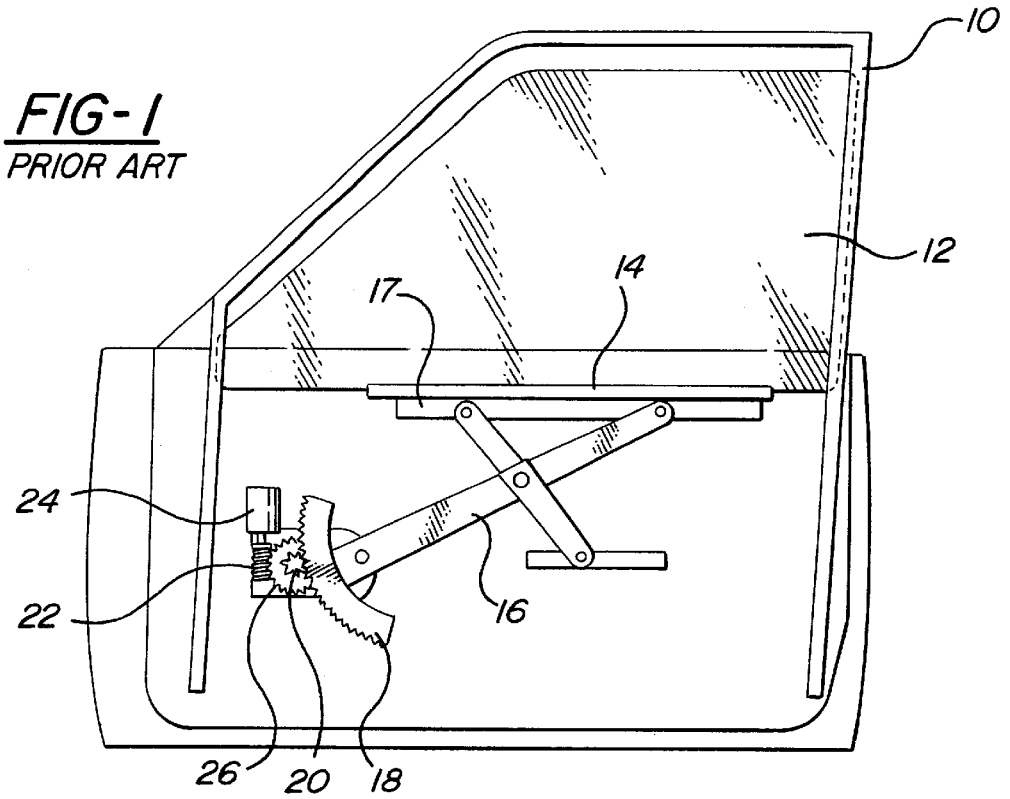
FIG-1 PRIOR ART
FIG. 1 is a perspective view of a prior art scissor-type window lift assembly.
Figure 2:
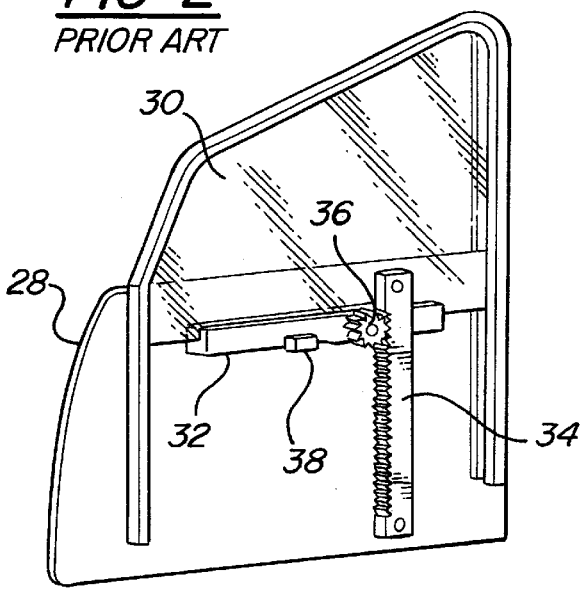
FIG-2 PRIOR ART
FIG. 2 is a perspective view of a first prior art rack-and-pinion window lift assembly.
Figure 3:
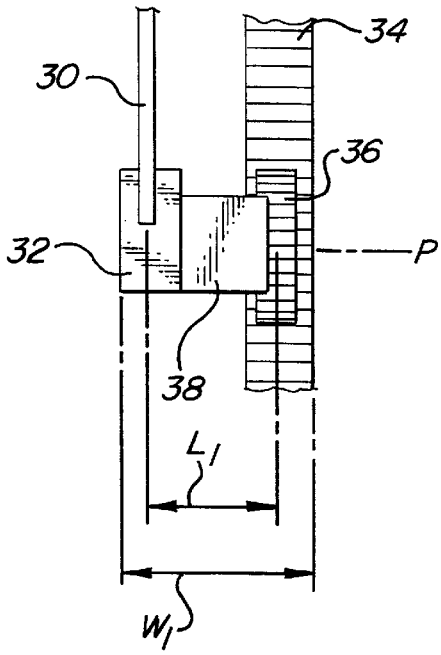
FIG-3 PRIOR ART
FIG. 3 is a cross-sectional view of a first prior art rack-and-pinion window lift assembly.

As previously stated, the object of the present invention is to minimize the space occupied by the various components in all dimensions and, in particular, in the thickness direction of the door. Contrasting this dimension in FIG. 3 (Pickles), FIG. 4 (Torii et al.), FIG. 5 (Fenelon), and FIG. 13 (the present invention), we observe that the embodiment of FIG. 3 has the largest thickness, the embodiments of FIGS. 4 and 5 are approximately equal to one another (but smaller than shown in FIG. 3), and that the present invention shown in FIG. 13 has the smallest thickness. Indeed, the thickness of the embodiment of the present invention is only limited by the thickness of the motor required to drive the unit. It is estimated that a width less than 30 mm is readily achievable. This compares with an estimated 50 mm minimum for previous embodiments. Additionally, the total number of parts has been greatly reduced so that a total weight of less than 1.5 pounds is attainable. This compares favorably with existing weights of arm and sector systems of 6.0 pounds or more.

The invention has been described in illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A closure assembly comprising:

a closure member;

a support bracket joined to said closure member;

a first pinion gear supported by said support bracket;

a first rack operatively engaged with said first pinion gear;

a driven gear supported for rotation by said support bracket and operatively joined with said pinion gear;

a motor supported by said support bracket and including an output shaft engaged with said driven gear;

said motor defining a profile in a width-wise direction;

said support bracket being positioned substantially within said width-wise profile of said motor to thereby minimize the space occupied by said motor and said support bracket; and a resilient shock absorber operatively engaged with said pinion gear.

2. The closure assembly of claim 1 wherein said width of said support bracket is less than or equal to said width of said motor.

3. The closure assembly of claim 2 wherein said motor has a width of approximately 35 millimeters.

4. The closure assembly of claim 1 wherein said support bracket is positioned entirely within said width-wise profile of said motor.

5. The closure assembly of claim 1 wherein said output shaft is contained within said support bracket.

6. The closure assembly of claim 1 wherein said driven gear is contained within a compartment in said support bracket.

7. The closure assembly of claim 1 wherein said support bracket is modular and includes an internal passage through which said output shaft extends and an enclosed compartment in which said driven gear is supported.

8. The closure assembly of claim 1 wherein said rack is disposed on a first side of said closure member and said motor has a center of gravity located on a second side of said closure member.

9. The closure assembly of claim 1 wherein said closure member is a vehicular window.

10. The closure assembly of claim 1 further comprising a second pinion gear supported on said support bracket and engaged with a second rack wherein said second rack is parallel to said first rack.

11. The closure assembly of claim 10 further comprising a first driven gear operatively engaged with said first pinion gear and a second driven gear operatively engaged with said second pinion gear.

12. A closure assembly comprising:

a closure member;

a support bracket joined to said closure member;

a first pinion gear supported by said support bracket;

a first rack operatively engaged with said first pinion gear;

a driven gear supported for rotation by said support bracket and meshingly engaged with said pinion gear;

a motor supported by said support bracket and including an output shaft engaged with said driven gear;

said motor defining a profile in a width-wise direction;

said support bracket being positioned substantially within said width-wise profile of said motor to thereby minimize the space occupied by said motor and said support bracket;

a second pinion gear supported on said support bracket and engaged with a second rack wherein said second rack is parallel to said first rack; and wherein said first pinion gear is meshingly engaged with said second pinion gear.

13. A closure assembly comprising:

a closure member;

a support bracket joined to said closure member, said support bracket defining an internal compartment;

a first pinion gear supported by said support bracket;

a first rack operatively engaged with said first pinion gear;

a driven gear supported for rotation and disposed within said internal compartment of said support bracket and operatively joined with said pinion gear;

a motor including an output shaft having a worm gear engaged with said driven gear; and said motor being connected to a first distal end of said support bracket wherein said output shaft is disposed within an internal passage of said support bracket and extends toward a second distal end of said support bracket whereby said support bracket can be positioned generally within a width-wise profile of said motor to minimize the space occupied by said support bracket and said motor.

14. The closure assembly of claim 13 wherein said support bracket includes a width which is less than or equal to the width of said motor.

15. The closure assembly of claim 14 wherein said motor has a width of approximately 35 millimeters.

16. The closure assembly of claim 13 wherein said motor defines a profile in a width-wise direction and said support bracket is positioned within said profile of said motor.

17. The closure assembly of claim 13 wherein said output shaft is contained within said support bracket.

18. The closure assembly of claim 13 wherein said rack is disposed on a first side of said closure member and said motor has a center of gravity located on a second side of said closure member.

19. The closure assembly of claim 13 wherein said closure member is a vehicular window.

20. The closure assembly of claim 13 further comprising a second pinion gear supported on said support bracket and engaged with a second rack wherein said second rack is parallel to said first rack.

21. The closure assembly of claim 20 further comprising a first driven gear operatively engaged with said first pinion gear and a second driven gear operatively engaged with said second pinion gear.

22. A closure assembly comprising:

a closure member;

a support bracket joined to said closure member, said support bracket defining an internal compartment;

a first pinion gear supported by said support bracket;

a first rack operatively engaged with said first pinion gear;

a driven gear supported for rotation within said internal compartment of said support bracket and operatively joined with said pinion gear;

a motor including an output shaft having a worm gear engaged with said driven gear; and said motor being connected to a first distal end of said support bracket wherein said output shaft is disposed within an internal passage of said support bracket and extends toward a second distal end of said support bracket whereby said support bracket can be positioned generally within a width-wise profile of said motor to minimize the space occupied by said support bracket and said motor;

wherein said support bracket is modular and includes an internal passage through which said output shaft extends.

23. A closure assembly comprising:

a closure member;

a support bracket joined to said closure member, said support bracket defining an internal compartment;

a first pinion gear supported by said support bracket;

a first rack operatively engaged with said first pinion gear;

a driven gear supported for rotation within said internal compartment of said support bracket and operatively joined with said pinion gear;

a motor including an output shaft having a worm gear engaged with said driven gear; and said motor being connected to a first distal end of said support bracket wherein said output shaft is disposed within an internal passage of said support bracket and extends toward a second distal end of said support bracket whereby said support bracket can be positioned generally within a width-wise profile of said motor to minimize the space occupied by said support bracket and said motor;

further comprising a resilient shock absorber operatively engaged with said pinion gear.

24. A closure assembly comprising:

a closure member;

a support bracket joined to said closure member, said support bracket defining an internal compartment;

a first pinion gear supported by said support bracket;

a first rack operatively engaged with said first pinion gear;

a driven gear supported for rotation within said internal compartment of said support bracket and operatively joined with said pinion gear;

a motor including an output shaft having a worm gear engaged with said driven gear; and said motor being connected to a first distal end of said support bracket wherein said output shaft is disposed within an internal passage of said support bracket and extends toward a second distal end of said support bracket whereby said support bracket can be positioned generally within a width-wise profile of said motor to minimize the space occupied by said support bracket and said motor;

further comprising a first resilient shock absorber operatively engaged with said pinion gear.

25. A closure assembly comprising:

a closure member;

a support bracket joined to said closure member, said support bracket defining an internal compartment;

a first pinion gear supported by said support bracket;

a first rack operatively engaged with said first pinion gear;

a driven gear supported for rotation within said internal compartment of said support bracket and operatively joined with said pinion gear;

a motor including an output shaft having a worm gear engaged with said driven gear; and said motor being connected to a first distal end of said support bracket wherein said output shaft is disposed within an internal passage of said support bracket and extends toward a second distal end of said support bracket whereby said support bracket can be positioned generally within a width-wise profile of said motor to minimize the space occupied by said support bracket and said motor;

a second pinion gear supported on said support bracket, and engaged with a second rack wherein said second rack is parallel to said first rack;

wherein said first pinion gear is meshingly engaged with said second pinion gear.

26. A closure assembly comprising:

a closure member;

a support bracket joined to said closure member;

a rack;

said rack comprising a longitudinal rail including teeth on first and second opposing sides of said rail, said teeth on said first side being fixed relative to said teeth on said second side;

a first pinion gear supported by said support bracket and engaged with said teeth on said first side of said rack; and a second pinion gear supported by said support bracket and engaged with said teeth on said second side of said rack whereby said first and said second pinion gears straddle said rack said first and second pinion gears being driven simultaneously by a dual drive mechanism.

27. The closure assembly of claim 26 further comprising:

a motor supported on said support bracket and including an output shaft;

said output shaft including a worm gear which is engaged with a first driven gear; and said first driven gear being supported for rotation by said support bracket and being operatively joined with said first pinion gear.

28. The closure assembly of claim 26 wherein said rack is flexible.

29. A closure assembly comprising:

a closure member;

a support bracket joined to said closure member;

a rack;

said rack comprising a longitudinal rail including teeth on first and second opposing sides of said rail;

a first pinion gear supported by said support bracket and engaged with said teeth on said first side of said rack;

a second pinion gear supported by said support bracket and engaged with said teeth on said second side of said rack whereby said first and said second pinion gears straddle said rack;

a motor supported on said support bracket and including an output shaft;

said output shaft including a worm gear which is engaged with a first driven gear;

said first driven gear being supported for rotation by said support bracket and being operatively joined with said first pinion gear; and a second driven gear engaged with said worm gear and operatively engaged with said second pinion gear.

* * * * *

UNITED STATES PATENT AND TRADEMARK OFFICE

CERTIFICATE OF CORRECTION

PATENT NO. : 6,216,394 B1
DATED : April 17, 2001
INVENTOR(S) : Paul J. Fenelon

It is certified that error appears in the above-identified patent and that said Letters Patent is hereby corrected as shown below:

Title page,
FOREIGN PATENT DOCUMENTS, reference 2, "WO 98/2615" should be -- WO 98/26145 --;

Column 1,
Line 9, "modem" should be -- modern --.

Signed and Sealed this

Eighteenth Day of December, 2001

*Attest:*

*Attesting Officer*

JAMES E. ROGAN
*Director of the United States Patent and Trademark Office*